US005207423A

United States Patent [19]

Short

[11] Patent Number: 5,207,423

[45] Date of Patent: May 4, 1993

[54] TENNIS RACKET STRING STRAIGHTENER

[76] Inventor: David Short, 11623 La Maida St., North Hollywood, Calif. 91601

[21] Appl. No.: 737,292

[22] Filed: Jul. 29, 1991

[51] Int. Cl.[5] ..... A63B 51/00
[52] U.S. Cl. ..... 273/73 R
[58] Field of Search ..... 273/73 R, 73 A, 73 B, 273/73 D; 19/115 R, 215; D28/21; 132/137, 142, 152, 219, 159

[56] References Cited

U.S. PATENT DOCUMENTS

| | | | |
|---|---|---|---|
| D. 62,246 | 4/1923 | Salm | D28/21 |
| D. 108,347 | 2/1938 | Schelhammer | D28/21 |
| D. 155,464 | 10/1949 | Ulvad | D28/21 |
| D. 162,519 | 3/1951 | Collins | D28/21 |
| D. 173,471 | 11/1954 | Bloch | D28/21 |
| D. 263,886 | 4/1982 | Soltsick | D28/21 |
| 287,506 | 10/1883 | Crabb | 19/115 R |
| 297,794 | 4/1884 | Hall | 19/115 R |
| 791,690 | 6/1905 | Grell | 132/137 |
| 1,684,362 | 9/1928 | Sawyer | 132/159 |
| 2,126,214 | 8/1938 | Schelhammer | 132/219 |
| 2,303,643 | 12/1942 | Illingworth | D28/21 X |
| 2,470,157 | 5/1949 | Gambino | D28/21 X |
| 3,872,873 | 3/1975 | Tupper | 132/159 |
| 5,035,429 | 7/1991 | Redrow | 273/73 R |

FOREIGN PATENT DOCUMENTS

| | | | |
|---|---|---|---|
| 2185411 | 7/1987 | United Kingdom | 273/73 A |
| 8906994 | 8/1989 | World Int. Prop. O. | 273/73 R |

*Primary Examiner*—V. Millin
*Attorney, Agent, or Firm*—John J. Posta, Jr.

[57] ABSTRACT

The improved tennis racket string straightener is a one-piece unitary pocket comb, preferably of molded plastic, with an elongated body and spaced integral teeth depending therefrom along the length thereof. The body has curved ends to prevent pocket snagging and includes a vertical lower plate from which the teeth depend, and a top horizontal flange acting as a hand grip. The plate is integral with the flange and connected thereto along the longitudinal center-line thereof. The teeth in one embodiment are all the same size and spacing. In another embodiment the teeth are of generally similar shape and size but the distance between adjacent teeth gradually increases the farther the teeth are away from the mid-point along the length of the comb. The teeth are generally triangular in front, rear and side elevation, thus generally wedge-shaped with apices pointing down, and the spaces defined thereby are generally triangular with their apices up. All apices are slightly rounded to prevent string damage. The sides of the teeth are recessed to provide raised rims. The rims, teeth, flange and plate are not more than about ¼ inch thick for maximum dimensional stability during molding.

8 Claims, 1 Drawing Sheet

TENNIS RACKET STRING STRAIGHTENER

BACKGROUND OF THE INVENTION

1. Field of the Invention

The present invention generally relates to tennis racket string means and more particularly to an improved type of portable tennis racket string straightener.

2. Prior Art

Numerous devices have been provided to aid in stringing or restringing a tennis racket. See, for example, U.S. Pat. Nos. 2,156,092, 2,268,276, 3,994,496 and 4,082,272. More recently, it has been recognized that it is desirable to keep the strings of a tennis racket in proper alignment with each other during tennis play in order to provide optimal racket efficiency and string durability.

Strings can come out of alignment with each other after only a few strokes of the tennis racket in play, due to modern high velocity hits and techniques where the tennis ball is not struck flush but instead is struck at an angle in order to import substantial ball spin or for angular direction. In most instances, when strings become misaligned, the player must then resort to finger tuning the racket by manually moving the strings to their proper positions. The alternative is to stop play and resort to available large bulky and expensive string straighteners which must be kept on the sidelines. Such straighteners may be ones, for example, such as those of U.S. Pat. No. 4,089,523 or 4,733,866, 4,776,591 or 4,489,942. U.S. Pat. No. 4,752,071 discloses a simple portable hook which, however, is used to straighten only one string at a time. Its use takes considerable time if, as is usually the case, a number of strings are out of alignment.

Accordingly, it would be desirable to be able to provide a simple, small, light weight, inexpensive pocket size string straightener without moving parts which could quickly and easily properly realign a number of racket strings during the time when a player is walking to the next position on the court and preparing for the next point.

SUMMARY OF THE INVENTION

The improved tennis racket string straightener of the present invention satisfies all the foregoing needs. The straightener is substantially as set forth in the Abstract of the Disclosure.

The straightener is used to realign the vertical, that is, the longitudinal strings of an already strung racket, not to string or restring a racket. The straightener is a unitary pocket comb with integral elongated main body preferably of molded plastic, with a vertical lower plate and top transverse flange forming a horizontal hand grip. The lower end of the plate is integral with depending, spaced triangular (in side and rear and front elevation) wedge-shaped teeth of molded plastic or the like disposed along the length of the comb. The comb has curved ends and is small enough to fit in a pocket of the tennis player's clothes.

The teeth are accurately dimensioned to realign the vertical strings of the racket, merely by inserting the teeth into a horizontal line of string spaces in the racket and gently pressing the teeth forward until they can go no further and thereafter withdrawing the comb. This procedure is repeated at two or three levels in the racket to fully realign the vertical strings, which are usually the ones which come out of alignment during use of the racquet in playing tennis. The realignment procedure takes only a few seconds and can be conducted while the player is walking to the next position for hitting or receiving the ball for the next point.

The teeth of the comb are spaced and dimensioned to fit a particular string array. There are five main arrays, depending on the make and model of tennis racket, requiring five different combs. In one embodiment, for example, the teeth of the comb are of equal size throughout and spaced equally apart throughout. In another embodiment, the teeth are of about equal size but are spaced progressively further apart as they are positioned from the transverse midline of the comb. In that embodiment, the comb is designed to be used horizontally on the racket with the comb midline tooth inserted in a vertical midline string space in the racket.

It is preferred that the entire comb be of molded plastic. In order to assure dimensional stability for the comb during and after such molding operation, no component of the comb is made thicker than about ¼ inch. Therefore, the teeth which may be, for example, more than ¼ inch thick at their roots from front to rear and side to side, preferably are recessed on the sides thereof to leave thin strong peripheral rims or ridges. The teeth point downwardly and the points thereof are slightly rounded to prevent string damage. The spaces therebetween are triangular with the apices up. The comb areas defining the apices are slightly rounded to also prevent string damage. Further features of the present invention are set forth in the following detailed description and accompanying drawings.

DRAWINGS

DETAILED DESCRIPTION

FIGS. 1-3 & 5

Figure 1:
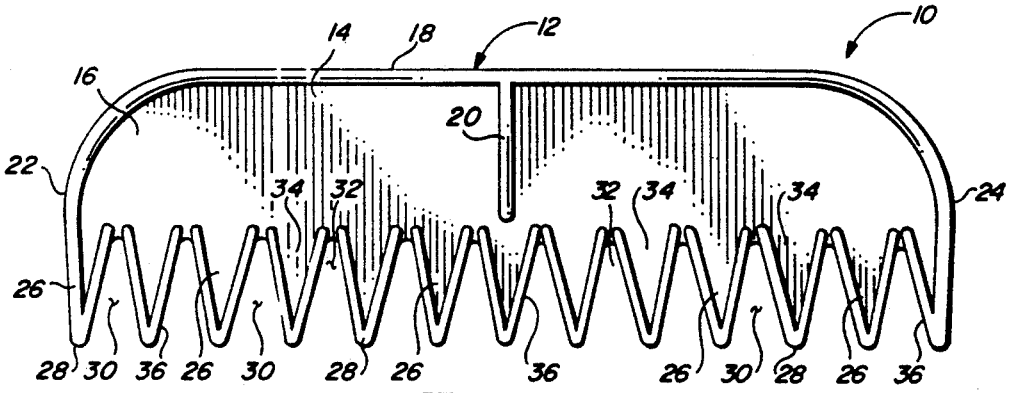
FIG. 1 is a schematic side elevation of a first preferred embodiment of the improved tennis racket string straightener of the present invention.
Figure 2:
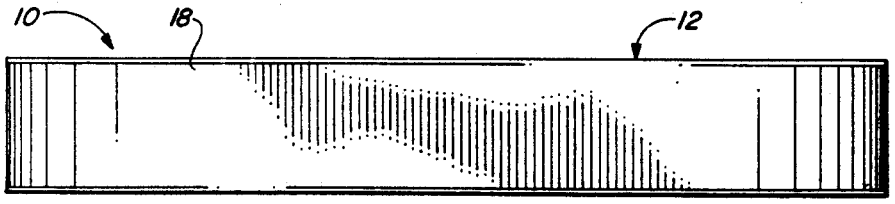
FIG. 2 is a schematic top plan view of the straightener of FIG. 1.
Figure 3:
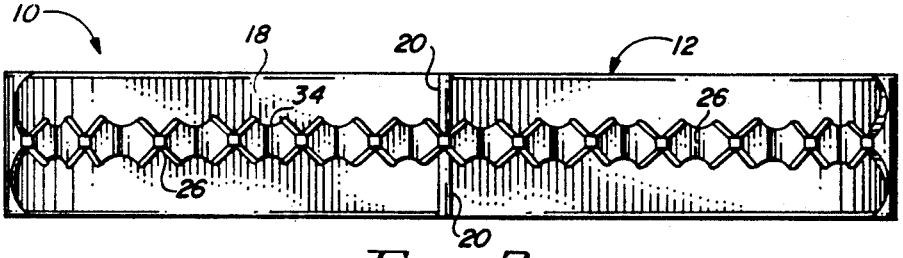
FIG. 3 is a schematic bottom plan view of the straightener of FIG. 1.

Now referring more particularly to FIGS. 1-3 & 5 of the drawings, a first preferred embodiment of the improved tennis racket string straightener of the present invention is schematically depicted therein. Thus, straightener 10 is shown which comprises a comb 12 having an elongated thin (e.g., ¼ inch thick) body 14, for example, about 6 inches long and about 1 inch deep, comprising a vertical lower plate 16 and a thin (e.g., ¼ inch thick) top transverse generally rectangular horizontal flange 18 which acts as a hand grip for comb 12. The upper end of plate 16 is integral with and connected to the underside of flange 18 along the longitudinal midline thereof so that flange 18 extends laterally on both sides of plate 16.

Body 14 may also include a pair of integral triangular braces 20 on the underside of flange 18 and both sides of plate 16 at the mid-point along the length of body 14. The opposite ends 22 and 24 of comb 12 are curved down to prevent pocket comb 12 from catching upon a tennis shorts pocket.

From the bottom of plate 16 depend a plurality of spaced substantially similar teeth 26. Teeth 26 are integral with plate 16. Each tooth 26 is generally triangular in side, rear and front elevation, with the point or apex 28 thereof pointing down and slightly rounded to prevent tennis racket string damage and damage to a pocket of tennis shorts in which comb 12 can be carried when not in use.

Thus, teeth 26 are wedge shaped and are spaced apart to define string-receiving triangular spaces 30 with the apices 32 thereof pointing up and slightly rounded in order to prevent racket string damage.

In comb 12, teeth 26 are arranged in a spaced particular racket string pattern to conform to a racket pattern whereby the spaces between strings gradually increase in diameter as the distance from the vertical centerline of the racket increases. Accordingly, those teeth 26 ahead of and behind braces 20 are gradually spaced further and further apart as they approach ends 22 and 24.

In use, comb 12 is initially aligned horizontally with the vertical tennis racket, using braces 20 as a guide to position the comb 12 at the vertical centerline of the racket. The tooth 26 of comb 12 closest to braces 20 is gently inserted in a racket string space at the racket vertical (longitudinal) centerline thereof, with the remaining teeth 26 being inserted in the proper string spaces along a horizontal line on either side of the vertical centerline space.

Comb 12 is then urged forward until the racket strings in space 30 touch the surfaces defining apices 32 and are automatically forced into proper alignment. Comb 12 is then withdrawn and quickly reinserted at another corresponding horizontal location above or below the first area of insertion. Usually, insertions at two or three such locations are adequate to fully straighten the vertical (longitudinal) racket strings. This can be done within a few seconds as the player walks to the next position between points but during play without interrupting play. Comb 12 can then be placed in a tennis shorts pocket until needed to be reused, usually after every three or four points.

It will be understood that the above description assumes that the racket will be held vertical and the comb will be inserted teeth first in a horizontal plane to straighten the strings However, the relative orientation of comb 12 and the racket will remain the same, whether the racket is held vertically or horizontally during straightening. Comb 12 is always used in a position perpendicular to the main plane of the racket and transverse of the racket.

Preferably, comb 12 is of fully unitary construction and is stiff and strong and comprises molded plastic. In order to assure the formation and maintenance of critical dimensions for comb 12 it is preferred that no component thereof be thicker than ¼ inch. Accordingly, plate 16 and flange 18 are no thicker than ¼ inch. Teeth 26 have reduced thickness due to the presence of side recesses 34 which define peripheral ribs 36, none of which are thicker than ¼ inch. Teeth 26 may be, for example, each about 6/16–7/16 inches long and wide at its base and about ¾ inch deep to its apex 28. Comb 12 is shown with 13 teeth, 26 spaced along a length of about 6 inches The overall height of comb 12 may be, for example, above 2 inches. Accordingly, comb 12 can be made relatively small, inexpensive, compact, light in weight, durable and efficient for its intended use. Various sizes of teeth 26 and spaces 30 are contemplated for various tennis racket string patterns.

FIG. 4

Figure 4:
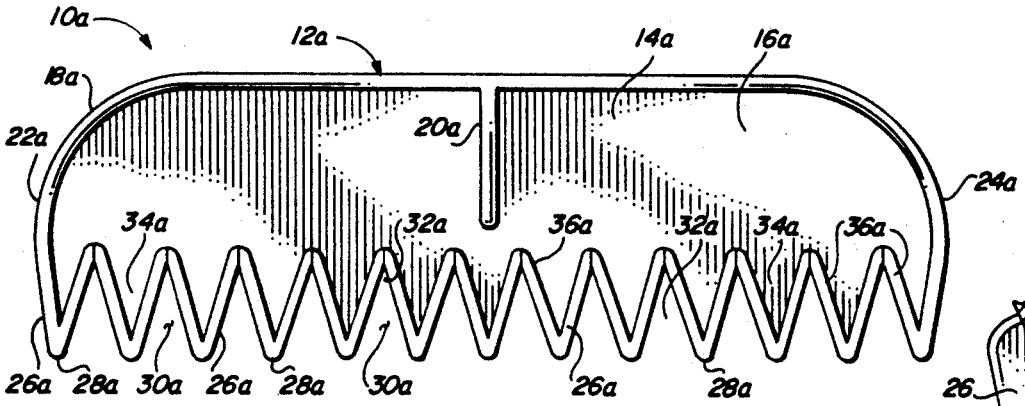
FIG. 4 is a schematic side elevation of a second preferred embodiment of the improved tennis racket string straightener of the present invention; and, FIG. 5 is an enlarged schematic side elevation of a tooth of the straightener of FIG. 1.
Figure 5:
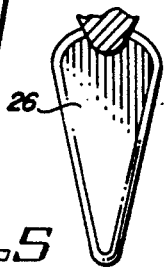

A second preferred embodiment of the improved tennis racket string straightener of the present invention is schematically depicted in FIG. 4. Thus, straightener **10*a* is shown. Components thereof similar to those of straightener 10** bear the same numerals but are succeeded by the letter "a".

Straightener **10*a* is identical to straightener 10, except as follows: Teeth 26*a* are identical to each other and are equally spaced apart throughout the length of comb 12*a* in order to conform to a particular standard racket string pattern. This is in contrast to comb 12 where teeth 26 are not precisely identical in size and are spaced increasing distances apart from the comb transverse mid-point as they approach opposite ends of comb 12. Thus, comb 12*a* is used with one racket string pattern and comb 12 is used with a different racket string pattern. Comb 12*a* has the advantages of comb 12. It will be understood that combs 12 and 12*a*** could be made of metal, wood, ceramic, cermet, etc., if desired and in various lengths and heights.

Various other modifications, changes, alterations and additions can be made in the improved tennis racquet string straightener of the present invention, its components and parameters. All such modifications, changes, alterations and additions as are within the scope of the appended claims form part of the present invention.

What is claimed is:

1. An improved tennis racket string straightener for straightening misaligned strings on a tennis racket, said straightener comprising a unitary structure having:

a) an elongated body having a straight bottom end; and, b) a plurality of spaced teeth unitary and integral with said body and depending from said bottom end along the length of said body, each said tooth being generally triangular in both front and rear elevation and side elevation, the apices of said teeth being pointed downwardly, the spacings between said teeth being generally triangular in side elevation with the apices of said spaces between said teeth being pointed upwardly, wherein each of said teeth are of approximately the same length;

c) wherein said teeth are introduced between the strings of a tennis racket to realign the strings on a tennis racket.

2. The improved tennis string straightener of claim 1 wherein said teeth are evenly spaced apart.

3. The improved tennis string straightener of claim 1 wherein the distance between adjacent teeth continuously increases as their distance from the center of the length of said body towards opposite ends of said body increases.

4. The improved tennis string straightener of claim 1 wherein said body has a generally flat, narrow vertical lower plate to the bottom end of which said teeth are integrally connected and depend therefrom, and a wide top horizontal flange connected to the upper end of said lower plate and providing a hand grip, and wherein the opposite ends of said body are curved down to avoid pocket snagging.

5. The improved tennis string straightener of claim 4 wherein said comb is of molded plastic, wherein said teeth have recesses on opposite sides thereof to provide raised side rims, whereby dimensional stability for said comb during and after molding thereof is provided.

6. The improved tennis string straightener of claim 5 wherein the apices of said teeth and said spaces are slightly rounded to preclude string damage.

7. The straightener of claim 1 wherein the spacings between adjacent teeth vary along the length of the body.

8. The straightener of claim 7 wherein the spacing between adjacent teeth gradually and continuously increase the farther the teeth are from the mid-point along the length of the comb.

* * * * *